US010722892B2

(12) United States Patent
Eccles et al.

(10) Patent No.: US 10,722,892 B2
(45) Date of Patent: Jul. 28, 2020

(54) TRANSFER DEVICE

(71) Applicant: Chargepoint Technology Limited, Liverpool (GB)

(72) Inventors: Christopher Eccles, Liverpool (GB); Benjamin Wylie, Liverpool (GB)

(73) Assignee: Chargepoint Technology Limited, Liverpool (GB)

( * ) Notice: Subject to any disclaimer, the term of this patent is extended or adjusted under 35 U.S.C. 154(b) by 55 days.

(21) Appl. No.: 15/757,609

(22) PCT Filed: Aug. 26, 2016

(86) PCT No.: PCT/GB2016/052659
§ 371 (c)(1),
(2) Date: Mar. 5, 2018

(87) PCT Pub. No.: WO2017/042536
PCT Pub. Date: Mar. 16, 2017

(65) Prior Publication Data

US 2018/0333725 A1 Nov. 22, 2018

(30) Foreign Application Priority Data

Sep. 8, 2015 (GB) ..... 1515865.2

(51) Int. Cl.
*B01L 3/00* (2006.01)
*B01L 1/02* (2006.01)

(52) U.S. Cl.
CPC ..... *B01L 3/563* (2013.01); *B01L 1/02* (2013.01); *B01L 1/025* (2013.01);
(Continued)

(58) Field of Classification Search
CPC ..... B01L 3/563; B01L 2200/026; B01L 2300/04; B01L 2300/046; B01L 3/567;
(Continued)

(56) References Cited

U.S. PATENT DOCUMENTS 6,685,060 B1 * 2/2004 Lee ..... B65D 90/626 222/148
6,827,242 B2 * 12/2004 Semenenko ..... B65G 69/183 222/185.1

(Continued)

FOREIGN PATENT DOCUMENTS

GB 2499909 A 9/2013

OTHER PUBLICATIONS

International Preliminary Report on Patentability received in PCT/GB2016/052659, dated Mar. 13, 2018.

(Continued)

*Primary Examiner* — Michael R Reid
(74) *Attorney, Agent, or Firm* — Suzannah K. Sundby, Esq.; Canady + Lortz LLP

(57) ABSTRACT

An assembly (10) (FIG. 1) having a passive beta port (12) and an active alpha port (14), the passive and the active are complementarily shaped such that they can engage with one another. The passive beta port (12) has an annular flange (16) defining an annular opening to which is releasably securable a passive port door (18). Disposed at the distal end of the passive (12), at the opposite end to the annular flange 16 is an annular clamp (22) having two handles (24). Disposed between the annular ring (16) and the annular clamp (22) is the gaiter (26) of the protective member (28). The protective member has a cylindrical body (30) forming a funnel through which material may pass. The free end (32) is sized so as to be capable of passing through the port formed between the alpha and beta ports (12, 14).

20 Claims, 18 Drawing Sheets

(52) U.S. Cl.
CPC ... *B01L 2200/026* (2013.01); *B01L 2200/141* (2013.01); *B01L 2300/04* (2013.01); *B01L 2300/046* (2013.01)

(58) Field of Classification Search
CPC . B01L 2300/049; B65G 53/46; B65G 69/183; B65G 53/4691; F16L 37/367
USPC ..... 251/149.2; 137/614.02, 614.12
See application file for complete search history.

(56) References Cited

U.S. PATENT DOCUMENTS

| | | | | |
|---|---|---|---|---|
| 9,416,882 | B2 * | 8/2016 | Miura | F16K 5/0605 |
| 2010/0180773 | A1 | 7/2010 | Hentzel et al. | |
| 2013/0167442 | A1 | 7/2013 | Sacca | |
| 2015/0027563 | A1 | 1/2015 | Barton | |

OTHER PUBLICATIONS

International Search Report received in PCT/GB2016/052659, dated Jun. 12, 2016.
Written Opinion received in PCT/GB2016/052659, dated Jun. 12, 2016.

* cited by examiner

TRANSFER DEVICE

FIELD OF THE INVENTION

The present invention relates to a transfer device and method for transferring material.

More particularly, the invention relates to apparatus and method for assisting in material transfer during manufacturing processes which may be undertaken in a traditional clean room or in an isolation and/or containment system employed for operator and/or process protection.

BACKGROUND OF THE INVENTION

The transfer of material from one aseptic vessel to another poses a number of problems particularly concerning maintenance of the aseptic environment to prevent the contamination of the material being transferred, the vessels themselves and the surrounding environment in which operators of such transfer devices may be located to effect the transfer of material.

The maintenance of sterility is of fundamental concern in many manufacturing processes, to safeguard against contamination of products being manufactured in the process. Exemplary industries using aseptic production in a traditional manner or in isolation and/or containment facilities include pharmaceutical, medical device, biotechnological and food industries.

Particular difficulty can arise where material for use in manufacture is required to be transferred from one sterile enclosure to another.

Developments in containment facilities led to the introduction of mating ports, otherwise known as rapid transfer (RTP) ports, to enable material to be transferred from one area to the other without contaminating the material or the surrounding environment.

However, these known ports are not without disadvantage. Commonly, the required location in the process enclosure is provided with a port which engages sealingly with a corresponding port of a transfer container. The mated ports can then be opened to enable material to be transferred from one area to another.

Such known transfer ports give rise to problems particularly when used in aseptic transfers. The presence of the seal or seals is an area of potential contamination which can be present on the exposed perimeter of the seals. Material to be transferred can easily come into contact with exposed sections of the seals compromising the sterility of the material and/or the process enclosure.

SUMMARY OF THE INVENTION

In accordance with a first aspect of the present invention there is provided a device for sealingly connecting a first and a second enclosed volume, comprising a first and second flange sealingly engageable with one another, the first flange being associated with the first enclosed space and the second flange being associated with the second enclosed space;

The first flange comprising a first port to allow the movement of material therethrough, said port being closable via a first port door sealably engaged with the first flange in a closed configuration and separated from the first flange in an open configuration to permit the passage of material therethrough;

The second flange comprising a second port to allow the movement of material therethrough, being closable via a second port door sealably engaged with the second flange in a closed configuration and separated from the second flange in an open configuration to permit the passage of material therethrough;

Wherein the device comprises a protective member capable of moving between an extended and a stowed configuration, and wherein when the first and second flanges are sealingly engaged with one another and in their second configuration, the protective member can move from its stowed configuration to its extended configuration such that it overlies the junction between the first and second flange and permits the passage of material through the first and second ports whilst protecting the material flowing therethrough from possible contamination from the junction.

In accordance with a further aspect of the present invention, there is provided an externally operated alpha/beta port system, comprising an alpha port assembly and a beta port assembly, wherein a) the alpha port assembly, comprises:

i. a flange fixable to an enclosure and defining a port;

ii. a door connectable to said flange when in a closed configuration such that said port is closed, said door being moveable to an open configuration wherein the port is open;

b) a beta port assembly comprises:

i) a flange fixable to a transfer container for containing material to be transferred, said flange defining a port;

ii) a door connectable to said flange in a closed configuration, which is moveable from a closed configuration in which the door is sealingly engaged with the flange and the port closed and a second open configuration in which the door is displaced from the flange and the port is open;

wherein, when in the second open configuration the door is connected to the door of the alpha port such that both doors can be moved to permit the transfer of material through the ports and wherein, the alpha and/or beta port comprises a protective member capable of moving between an extended and a stowed configuration, and wherein when the first and alpha and beta ports are sealingly engaged with one another and, the protective member can move from its stowed configuration to its extended configuration such that it overlies the junction between the first and second flange assemblies and permits the passage of material therethrough whilst protecting the material transferred from possible contamination from the junction.

The alpha and beta port are preferably engageable with one another and secured thereby via mating means.

The mating means may comprise a male member disposed on one of the alpha or beta port and a female member disposed on the other.

Suitably the male member comprises a bayonet fixing and the female a complementarily shaped recess.

Most suitably, the male member is disposed on the beta port and the female member on the alpha port.

More suitably still, each port comprises a plurality of mating members.

The mating members may be disposed on the doors to the alpha and beta.

The mating means may comprise a bayonet fitting, a push-fit connection or other suitable means.

The beta port may comprise a protective member.

The protective member may comprise a funnel shaped to overlie the junction between the alpha and beta and permit the passage of material therethrough.

The protective member may further comprise a gaiter.

The gaiter is suitably made from a flexible material to enable the gaiter to permit movement of the protective member from a first stowed configuration whereby the protective member does not overlie the junction between alpha and beta ports and can be retained behind the door of the beta when the door is engaged in its closed configuration and movement to a deployed, extended configuration whereby the protective member is capable of overlying the junction between the alpha and beta port.

The flexible wall preferably has means to determine the degree of deformation of the wall when moved from the stowed to the deployed configuration. Most suitably, this consists of two convolutes or segments giving a defined position when stowed and a defined position when deployed. More suitably still, there is an absence of a stable intermediate position.

The means may comprise annular wall thickenings at predetermined positions.

The gaiter may comprise a flexible wall sufficiently rigid to hold the protective member in position in either configuration but flexible enough to permit movement.

The protective member and gaiter may be integrally formed. The flexible wall of the gaiter may be integrally formed with a transfer bag.

The protective member may be moved between its configurations by externally applied force.

The protective member may be operatively connected to actuating means disposed on a transfer bag which enable an operator to move the protective member between its configurations.

The actuating means may comprise a handle which an operator may use to apply force to move the protective member between its configurations.

The alpha port may be associated with actuating means for controlling the opening and closing of the ports.

The actuator may be operatively connected to the door of the alpha port.

The actuator may be capable of translational movement of the door and rotational movement of the door.

The actuator may be operatively connected to a curved arm to which the door is mounted at one end and to which the other end is mounted on a shoulder, wherein the shoulder is capable of translational movement to move the door rearwardly from the alpha port and capable of rotational movement to pivot the door away from the alpha port such the door does not obstruct the port.

Pivoting the door away from the alpha port as described above reduces the impact of such a mechanism on the air flow with an enclosure. Typically, an enclosure will have means for generating airflow in the ceiling which will displace air downwardly away from the ceiling. The door being moved out of the way of the port as described above ensures that the door has a relatively low profile and is disposed close to the enclosure wall when opened and moved out of the way of the port. Thus there is minimal profile of the door and its arm to present to the airflow thus reducing the impact of the door being open on the functioning of the enclosure.

The alpha port may further be associated with a chute for directing material way from the alpha port when transferred into the chamber.

The beta port may also comprise means to permanently engage the door once the door has been opened and then reengaged with and the port and in its closed configuration.

The protective member is suitably externally operated to move between its configurations. The protective member is suitably externally operated of the enclosed volume of the isolator barrier chamber and/or where the beta port or second port is connected to a transfer container, for example, the enclosed volume of the transfer container.

The opening and closing of the doors may be automated.

The system may be used for a rapid transfer port (RTP) system.

The enclosure may comprise any one or more of the following: chamber, isolator chamber, restrictive access barrier (RAB), screen or the like.

The system or device may be an aseptic transfer system or device.

The system may further comprise a module comprising a housing defining an enclosed chamber with an inlet and an outlet. The inlet is connectable to the beta port and the outlet is connectable to an enclosure. The inlet comprises the alpha port. The module permits the system to be used on enclosures not having an alpha port as described hereinabove but having a closable inlet to which the outlet of the module may connect.

BRIEF DESCRIPTION OF THE DRAWINGS

The present invention will now be described, by way of example only, with reference to the accompanying figures, in which.

DETAILED DESCRIPTION OF THE INVENTION

Figure 1:
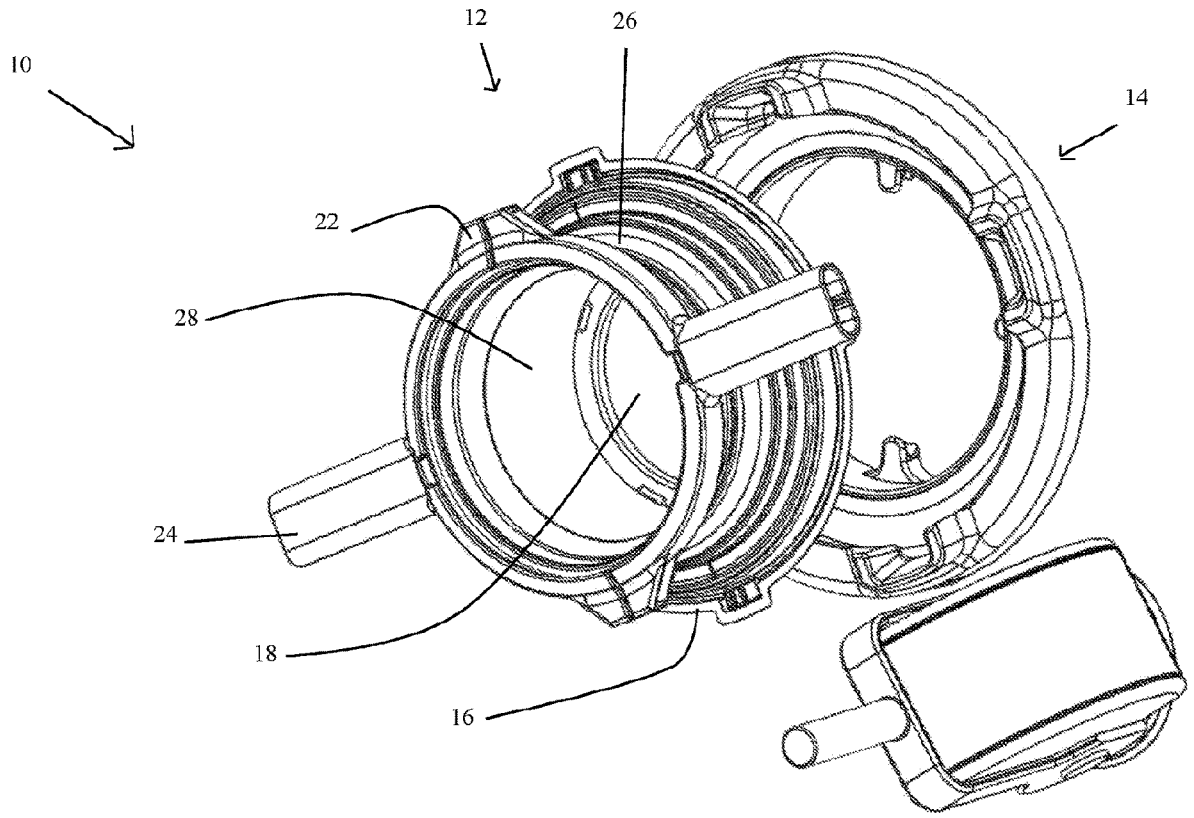
FIG. 1 is a perspective view of an assembly in accordance with the present invention.

The figures show an assembly 10 (FIG. 1) having a passive beta port 12 and an active alpha port 14, the passive and the active are complementarily shaped such that they can engage with one another.

The passive beta port 12 has an annular flange 16 defining an annular opening to which is releasably securable a passive port door 18. Disposed at the distal end of the passive 12, at the opposite end to the annular flange 16 is an annular clamp 22 having two handles 24.

Figure 2:
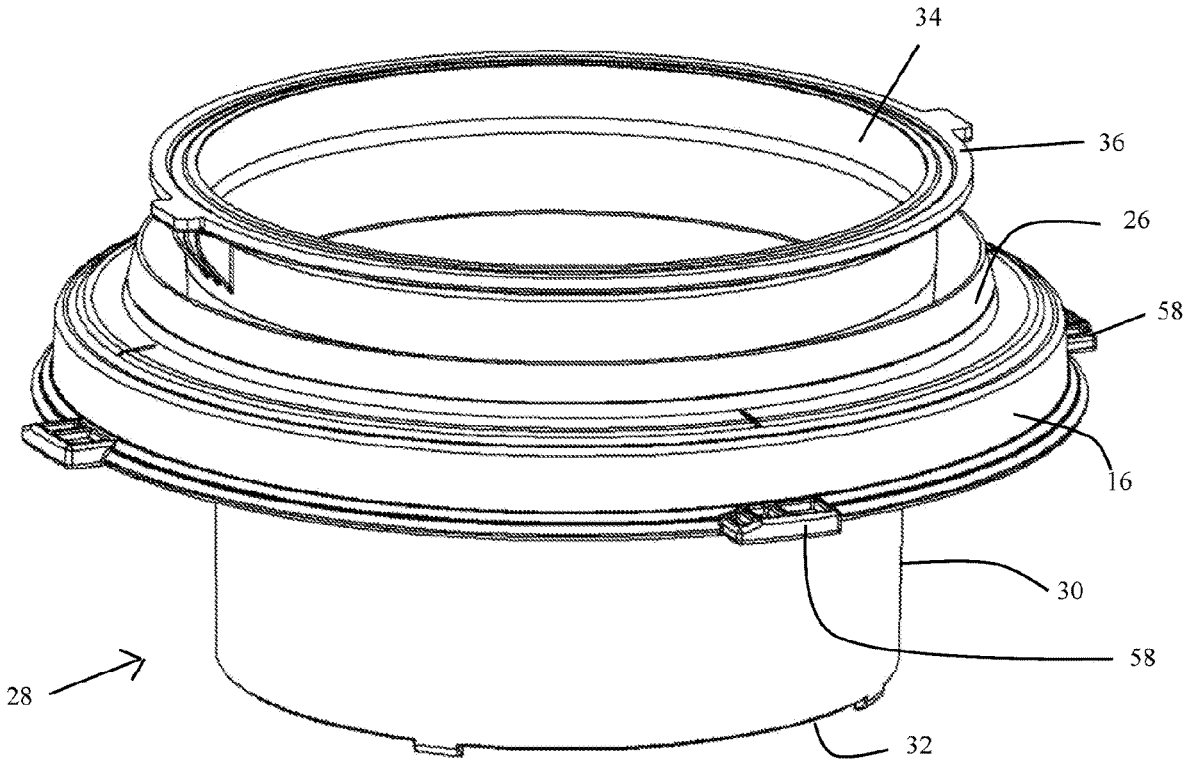
FIG. 2 is a perspective view of a protective member in an extended configuration in accordance with the present invention.

Disposed between the annular ring 16 and the annular clamp 22 is the gaiter 26 of the protective member 28 (FIG. 2). The protective member has a cylindrical body 30 forming a funnel through which material may pass. The free end 32 is sized so as to be capable of passing through the port formed between the alpha and beta ports 12, 14.

Figure 3:
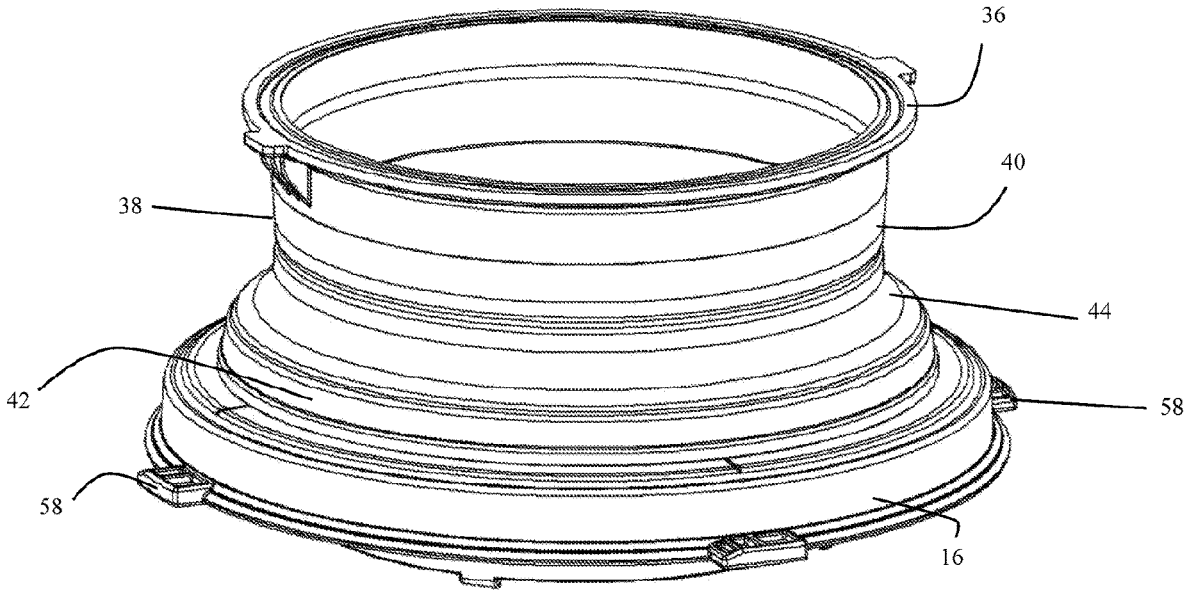
FIG. 3 is a perspective view of a protective member in its stowed configuration in accordance with the present invention.

The other end 34 of the protective member 28 comprises a circular clamp flange 36 for co-operating with annular clamp 22 to secure a flexible walled container therebetween (not shown). Extending between clamp flange 36 and port flange 16 flexible gaiter 26 which enables the protective member 28 to move from a stowed configuration in which the cylindrical body 30 extends near to, or preferably slightly beyond the flange 16 (FIG. 3) and the extended configuration in which the cylindrical body 30 extends significantly beyond the flange 16 (FIG. 2).

The gaiter 26 has a flexible wall 38 which when lengthened, in the stowed configuration of the protective member, has a narrow section 40 proximal to the flange 36 and a wider section 42 proximal to the flange 16. The flexible wall has a waist 44 at which the gaiter 26 widens from the flange 36 towards the flange 16.

The gaiter 26 is formed in such a manner so as to have a number of discrete configurations. The flexible wall 38 of the gaiter 26 has annular thickenings to provide the means for determining the discrete configurations such that the movement of the protective member 28 from its stowed configuration to its extended configuration, and vice versa, is pre-determined so that the cylindrical body will extend a predetermined distance beyond the flange 36 and provides positive feedback to a user so that they can be certain that the protective member has been successfully deployed in the correct position. This consists of two convolutes or segments giving a defined position when stowed and a defined position when deployed. There is an absence of a stable intermediate position provided for by the flexible nature of the wall 38 and the thickenings such that the protective member is biased into the stowed or deployed position and will resist an intermediate position so that a user can be certain of the one of two configurations during use. This enable a user to determine when to transfer material and when to attach the port door 18 of the beta port after use.

Figure 4:
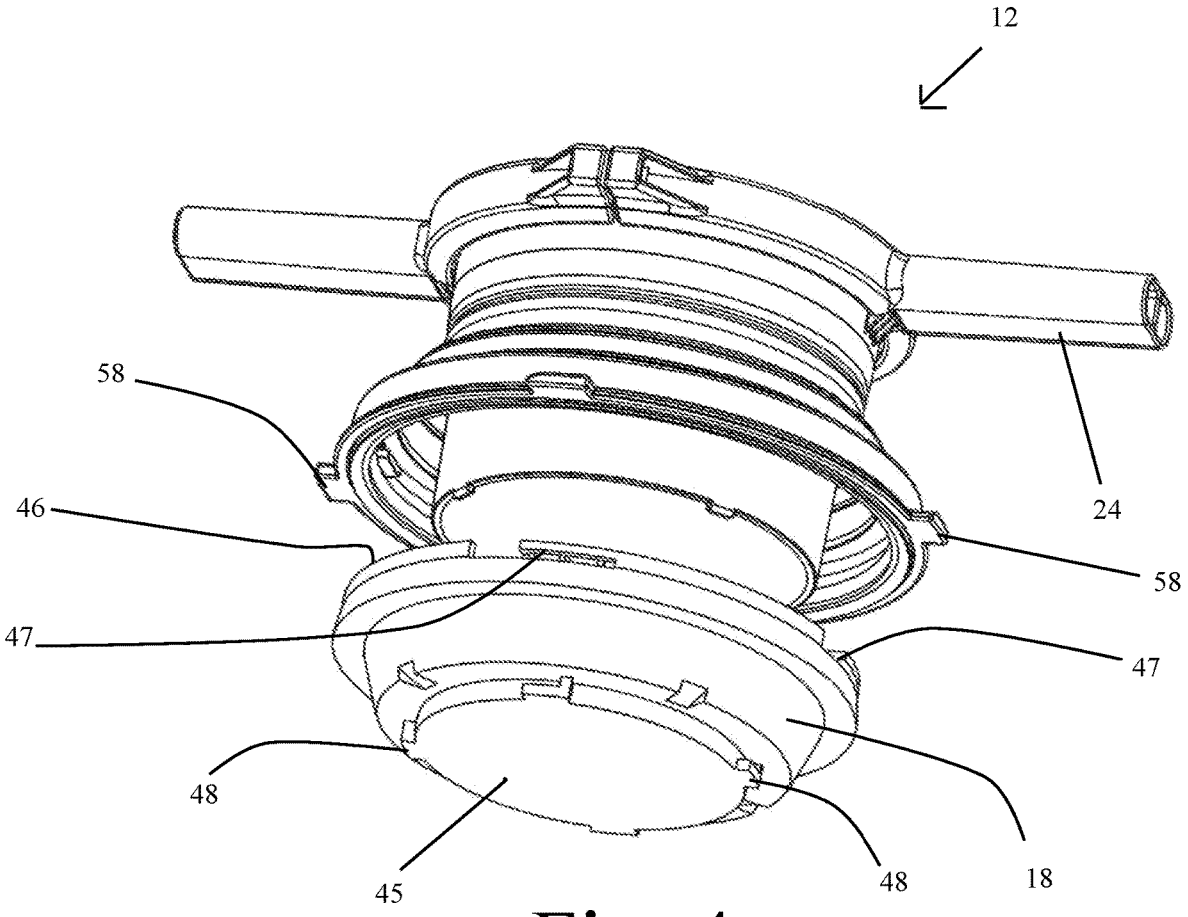
FIG. 4 is a perspective view of a beta port in accordance with the present invention with the door detached.

FIG. 4 shows the beta port 12 with passive door 18 detached. The passive door 18 has a hollow generally frustoconical body having circular planar end wall 45 and an open end 46 having four slots 47 disposed equidistantly circumferentially and complementarily shaped to the locating tabs 58 on annular flange 16, so as to receive the tabs 58 to selective retain the door 18 in place. Circumferentially and equidistantly disposed around the end wall 45 are locating tabs 48 complementarily shaped to retaining groves 49 disposed on the door 50 of the active port.

Figure 5:
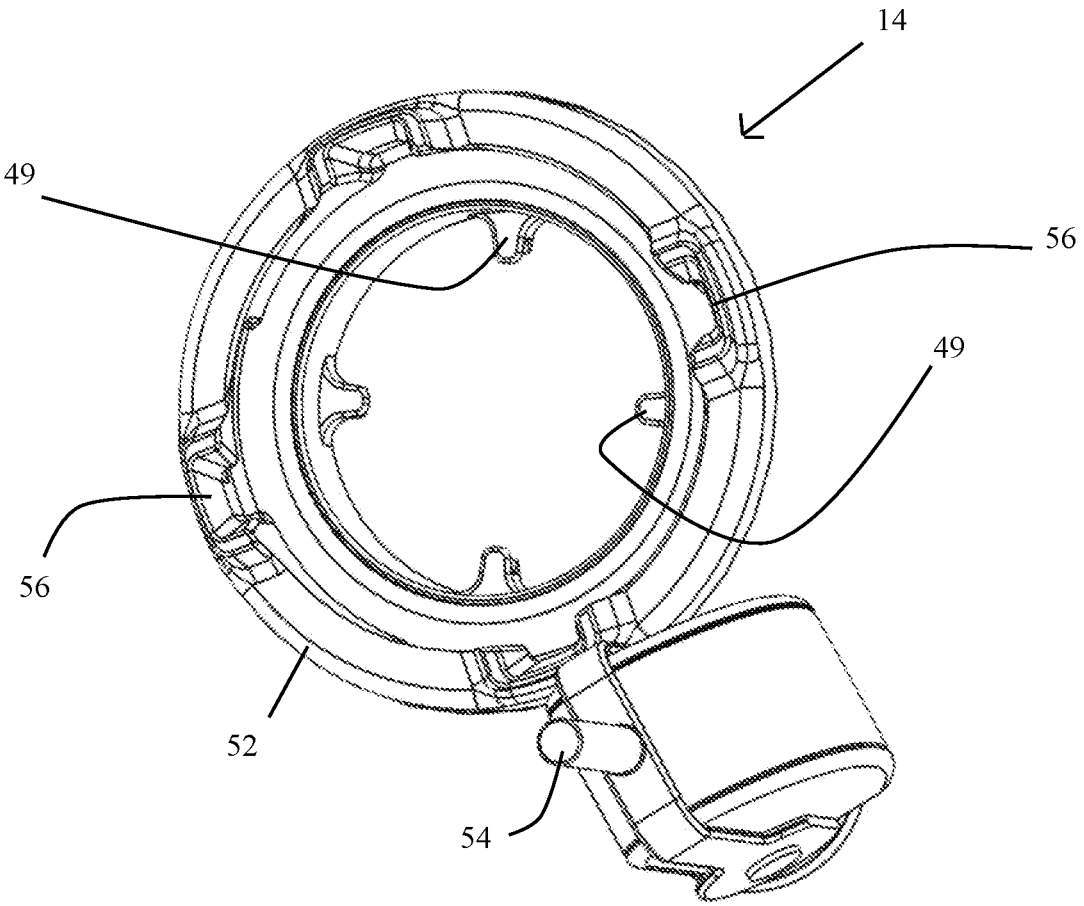
FIG. 5 is an external view of an alpha port in accordance with the present invention.

FIG. 5 shows the alpha port 14 closed with alpha port door 50 in its closed configuration, engaged with annular flange 52. To one side of the port 14 is an actuator 54 for actuating opening and closing of the alpha/beta ports when engaged.

The annular flange 52 has four recessed slots 56 disposed equidistantly around its circumference. The slots are complementarily shaped to that of the bayonet locating tabs 58 disposed equidistantly about the circumference of annular ring 16 of the beta port.

Figure 6:
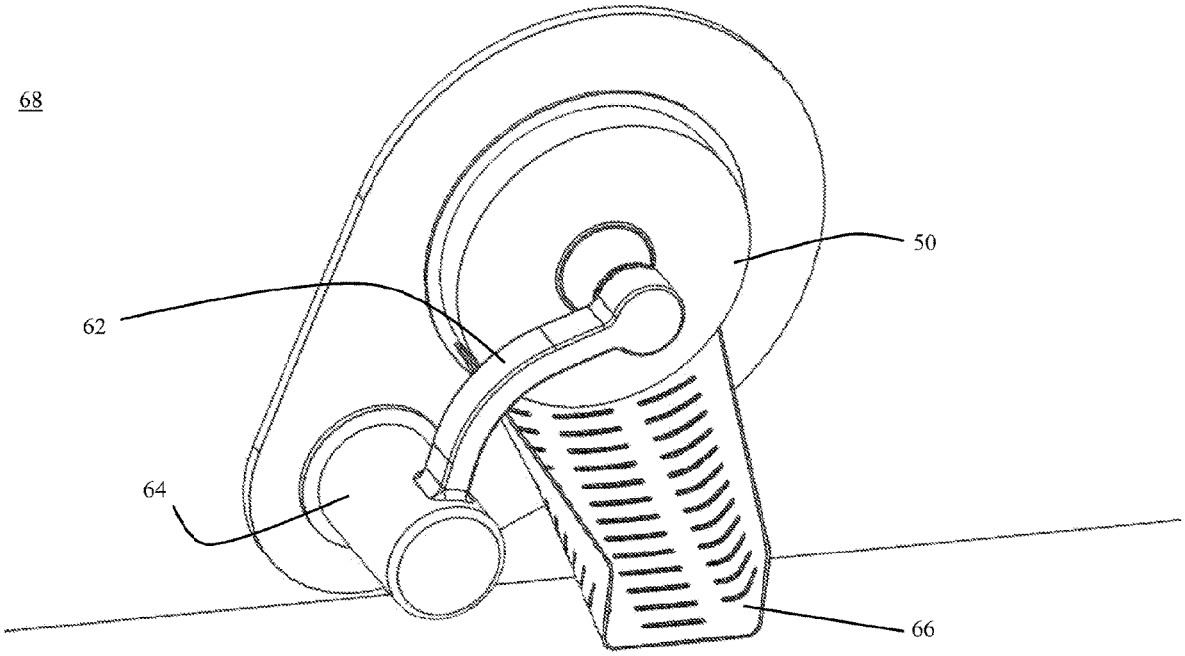
FIG. 6 is an internal view of an alpha port in accordance with the present invention.

In use the locating tabs 58 assist in positioning the beta port in the correct alignment with the alpha port. FIG. 6 shows the alpha port door 50 in its closed configuration from inside the isolator barrier chamber. Operatively connected to the door 50 is actuating arm 62 which has a curved profile which is fixed at one end to an extendable shoulder 64 which also is capable of pivoting the arm away from the alpha port when in an open configuration. Extending from the lower circumference of the inner face of flange 52 is a chute 66 for receiving material and directing it away from the inner wall 68 of the chamber. The actuating arm 62 has a curved profile to provide a clearance with the chute when the alpha port door is closed. The pivot is located below and to one side of the chute to provide ergonomic opening of the door, meaning that (1) the angle of rotation required to open the door is preferably not more than 90 degrees, (2) the torque required to open or close the door is within ergonomic ranges, and (3) the arc of movement is such that the weight of the door provides a stable position when the door is open and a stable position when closed.

Figure 7:
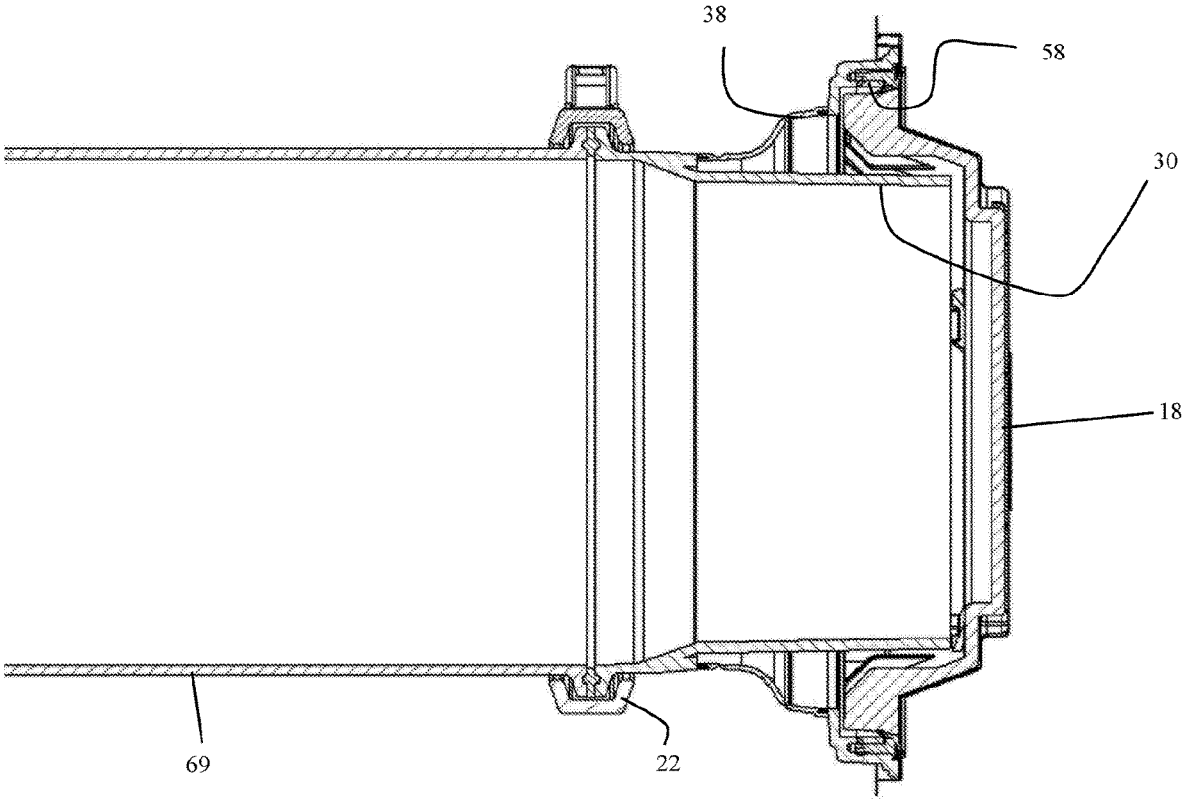
FIG. 7 is a sectional view of a beta port attached to a container in accordance with the present invention.

FIG. 7 shows the beta port attached to a container 69. In a first configuration the alpha and beta ports are connected; flanges 16 and 52 are engaged. The doors 18 and 50 are still in their closed configuration.

Figure 8A:
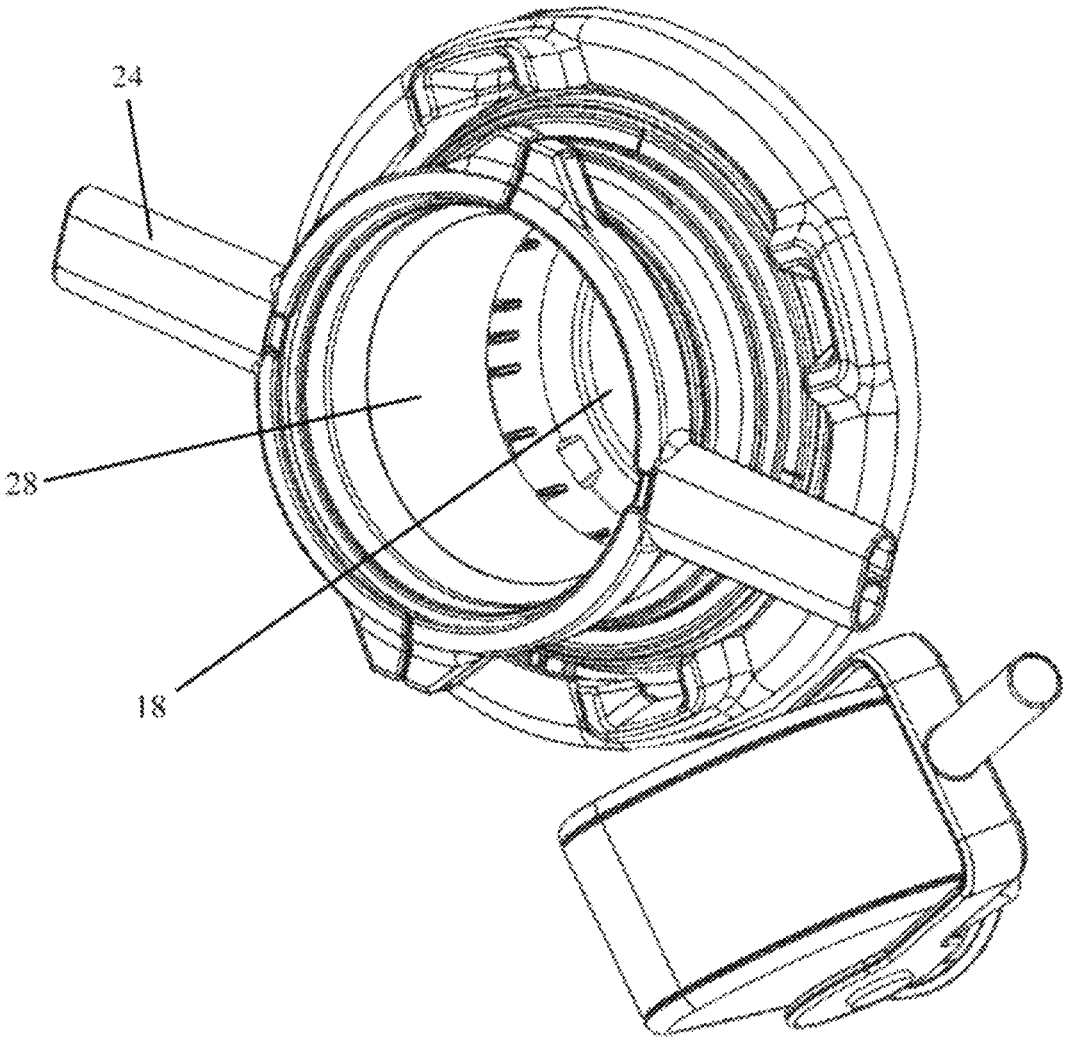
FIGS. 8*a* and *b* are a perspective and sectional view respectively of an alpha and beta port in accordance with the present invention with the doors displaced and a perspective view of the ports in this configuration.
Figure 8B:
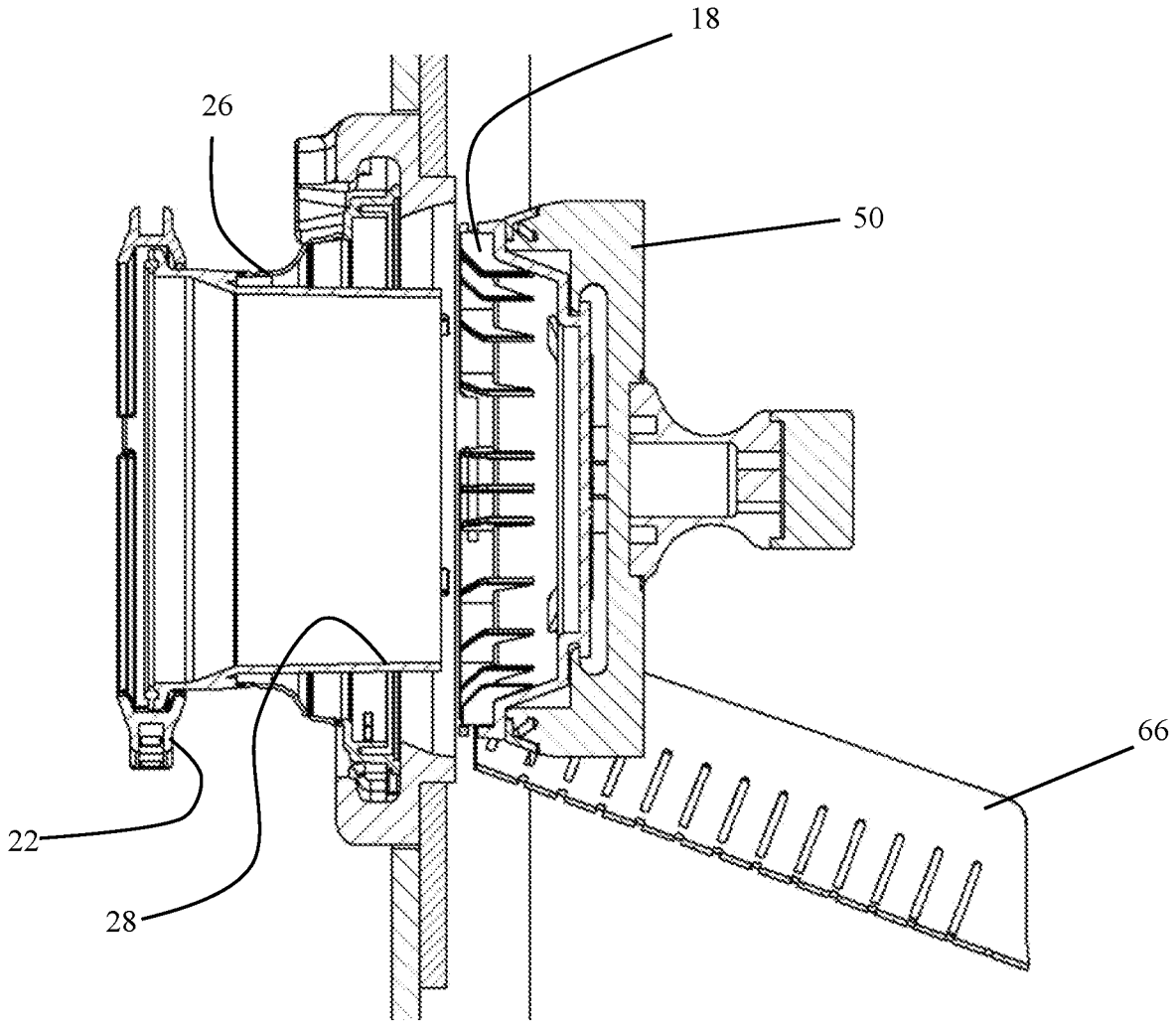

FIGS. 8*a* and *b* show the doors 18 and 50 disengaged with their respective flanges 16, 52 and they have been translationally displaced toward the interior of the chamber.

Figure 9A:
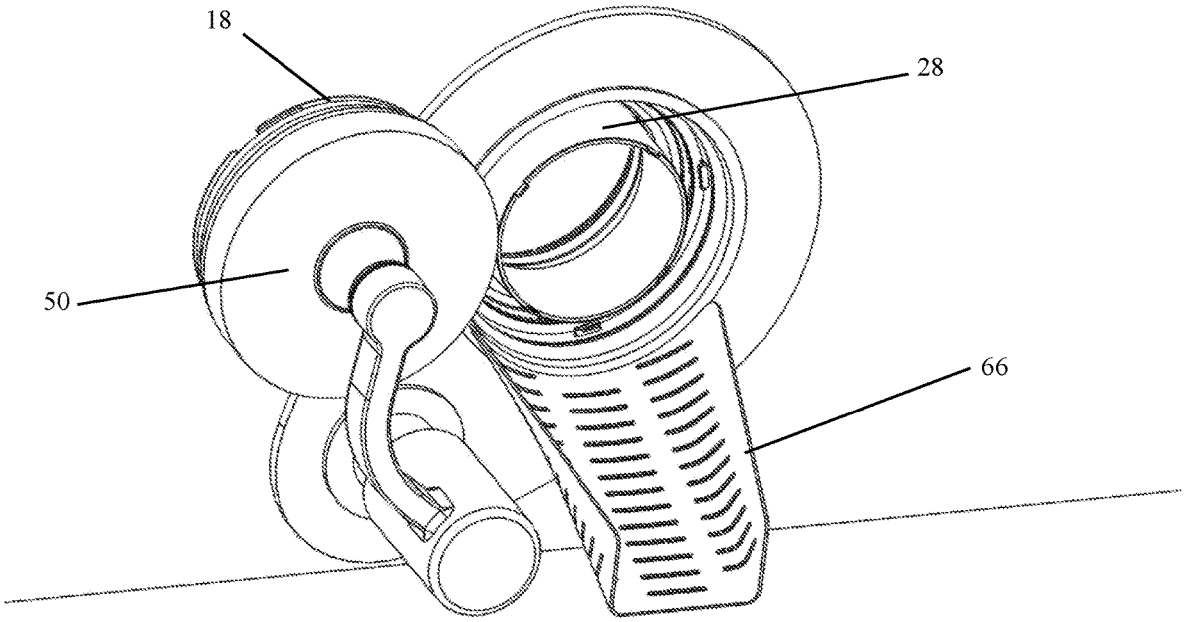
FIGS. 9 *a* to *c* are two perspective views and a sectional view respectively of an alpha and beta port in accordance with the present invention with the doors displaced and rotated, a perspective view of the ports in this configuration and an internal view of a chamber in this configuration.
Figure 9B:
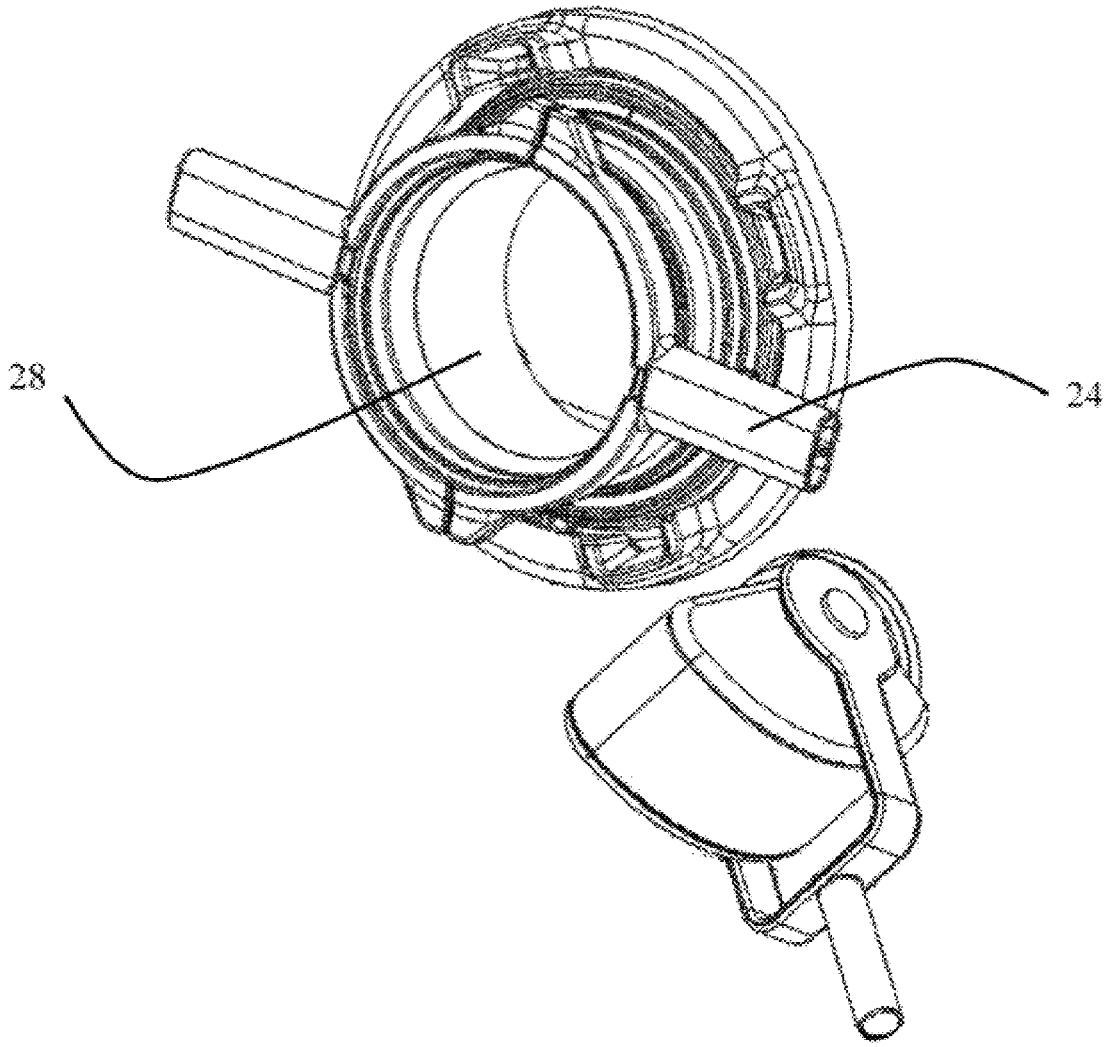
Figure 9C:
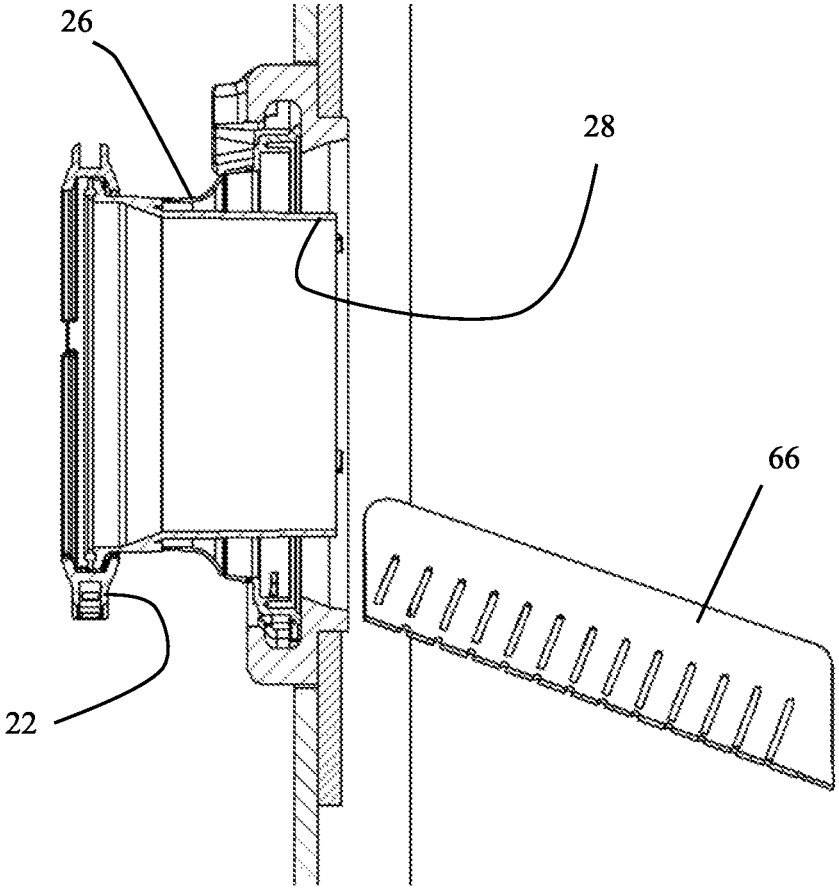

FIGS. 9 *a* to *c* show the alpha and beta ports in a third configuration: the doors 18, 50 are engaged with one another; the door of the alpha port 50 disengaged from its respective flange 16 52; the Beta port door 18, disengaged from lugs 58 that lie on the internal surface of the proximal flange 16; and the actuating arm has pivoted about shoulder 64, rotating the doors 18, 50 out of the path of the alpha and beta ports such that there is a through hole therebetween connecting the chamber with the interior of the container to which the beta port can be secured. The cylindrical body 30 of the protective member 28 can be seen in its stowed configuration.

Figure 10A:
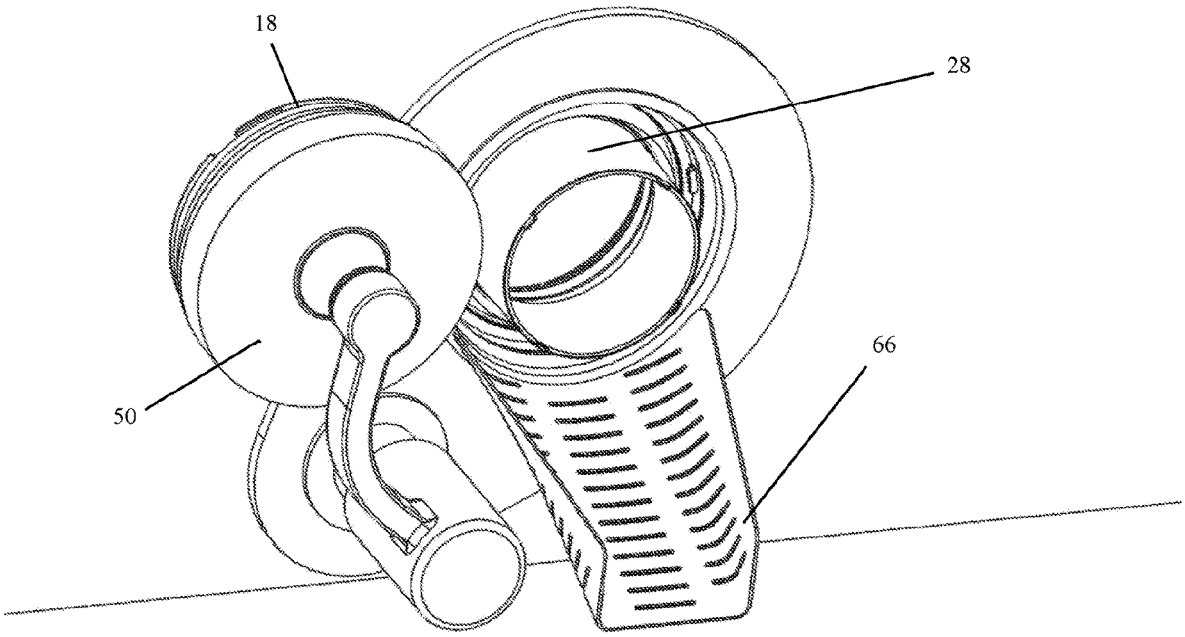
FIGS. 10 *a* and *b* are a perspective and sectional view respectively of an alpha and beta port in accordance with the present invention with the doors displaced and rotated and the protective member deployed, a perspective view of the ports in this configuration and an internal view of a chamber in this configuration.
Figure 10B:
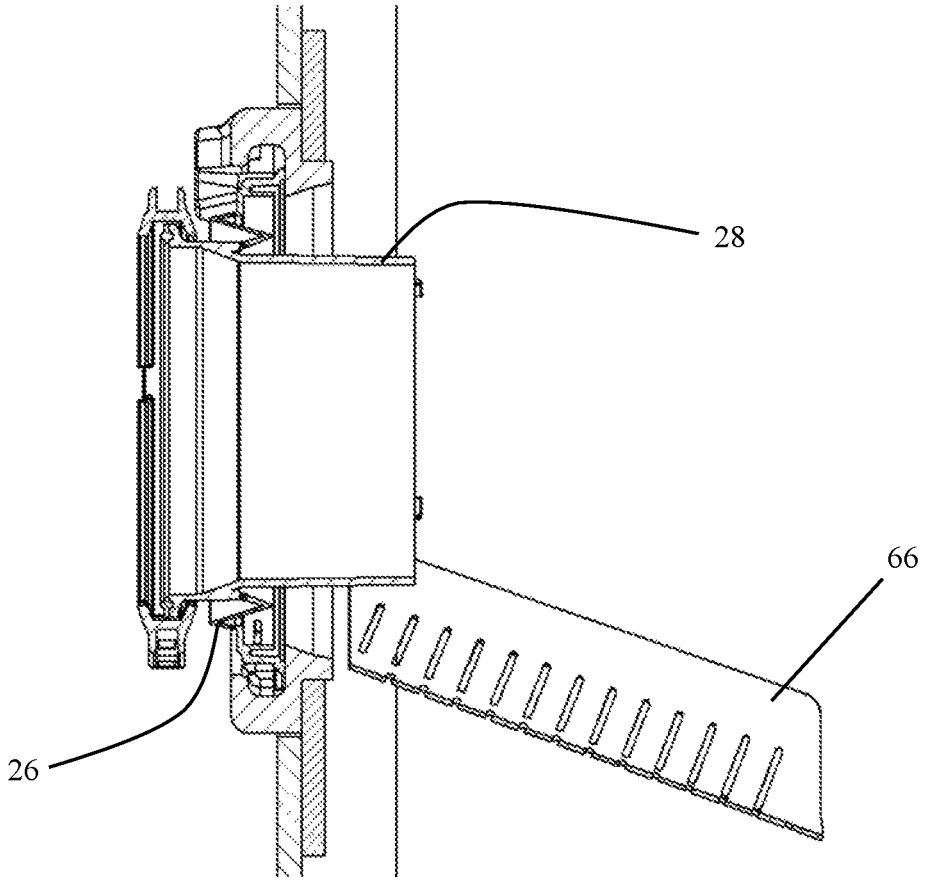

FIGS. 10*a* and *b* show the third configuration of the alpha and beta ports (FIGS. 9*a* to *c*) but with the protective member 28 deployed in its extended configuration. The flexible wall of the gaiter has deformed to permit the protective member to move to its extended configuration and the predetermined positions provided by the annular thickenings are clearly seen. Further, the cylindrical body 30 now extends over the junction between the alpha and beta ports and into the chamber, above the chute 66. Material can now be safely transferred through the ports without fear of contamination from any contaminants which may be present at the junction between the ports.

Once material has been transferred, the process is reversed to close the doors of the ports and disengage the beta from the alpha.

Figure 11:
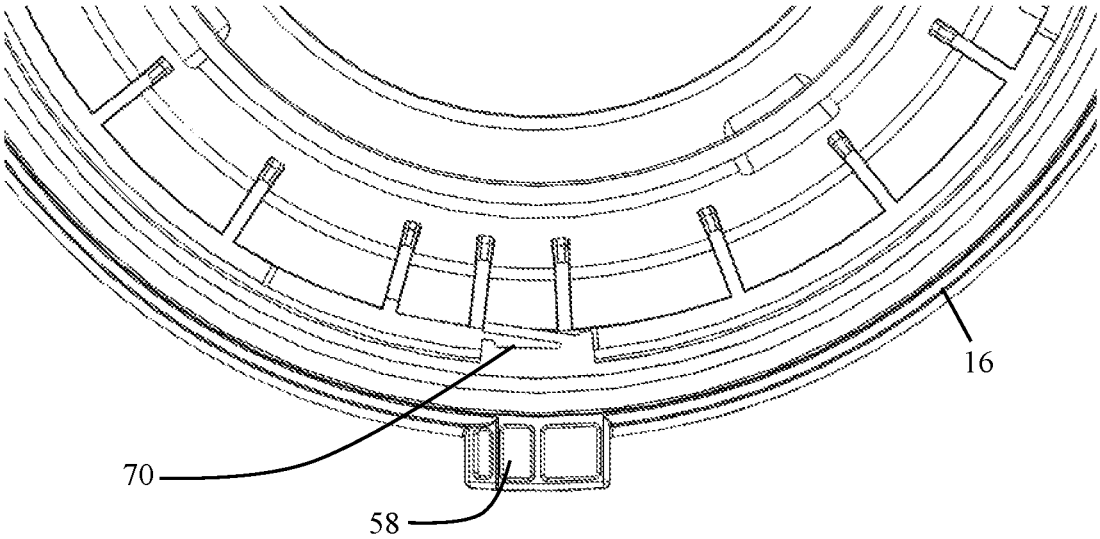
FIG. 11 is a perspective view of a beta port with a lock out feature.

FIG. 11 shows a lock out function on the beta port which prevents the beta from being reused which will help maintain aseptic conditions. The lock out function ensures that when the door 18 is reengaged with the flange 16 of the beta, the door is permanently fixed to the flange preventing re-opening and reuse of the container and its port. The lock out feature comprises a non-return clip 70 on the internal surface of the proximal Passive flange, which prevents the lugs and slots of Passive door 20 and Passive flange 16 being rotated into alignment with their starting position, such that the Passive door cannot be readily detached from the Passive flange after transfer has taken place. The lock out function is primed automatically (without reliance on any other user action) when the Passive door is first released from the Passive flange.

Figure 12:
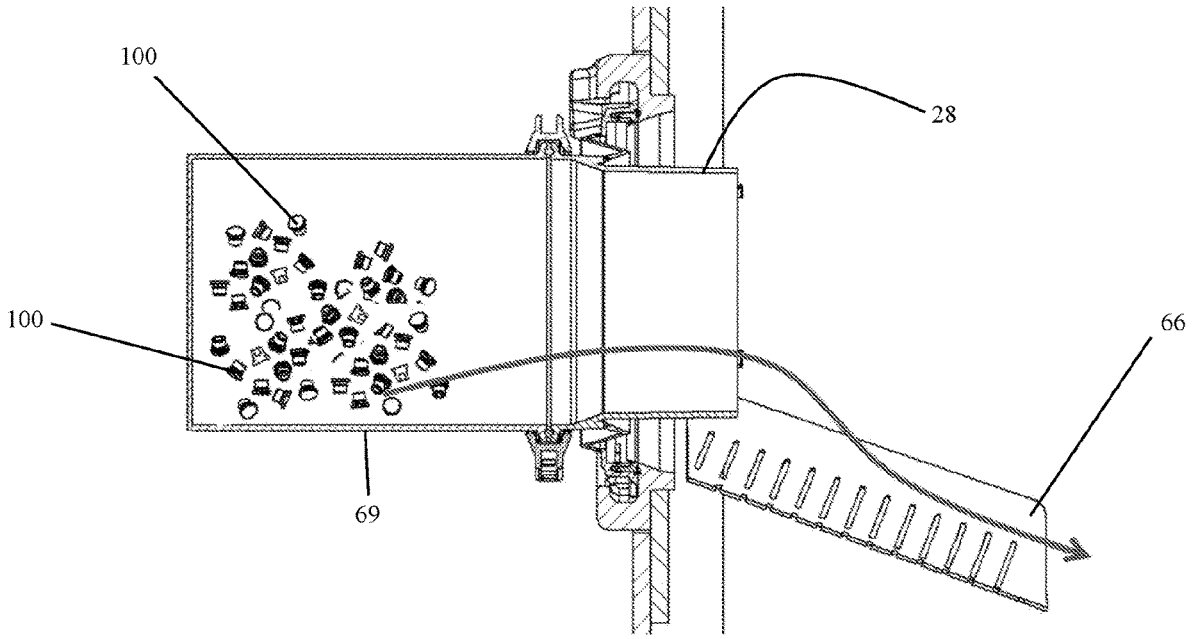
FIG. 12 is a sectional view of an alpha and beta port connected in accordance with the present invention showing the movement of material therethrough and the protective member deployed in its extended configuration.

FIG. 12 shows the transfer of material 100 from container 69 into the interior of the chamber, the direction of travel shown by the arrow. The protective member is deployed and overlies the ring of concern thus avoiding contamination.

Figure 13:
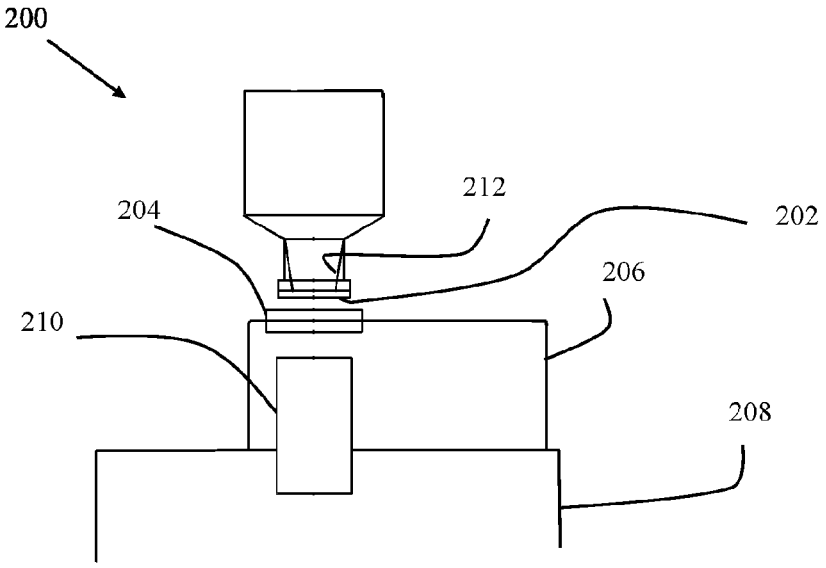
FIG. 13 shows another embodiment in accordance with the present invention.

FIG. 13 shows an assembly 200 having a passive beta port 202 and an active alpha port 204, the passive and the active are complementarily shaped such that they can engage with one another and have features of that described hereinabove. Lying between the ports 202, 204 is a transfer module 206 comprising a chamber which has at one end the alpha port and at the other a connector for mating with a conventional isolator chamber 208 or the like. The advantage of the module is to enable existing systems to benefit from the advantages associated with the present invention. Extending between the transfer module and the isolator chamber is a chute 210 which is connectable to the protective member 212 when in its deployed configuration to facilitate through passage of material therethrough.

Figure 14:
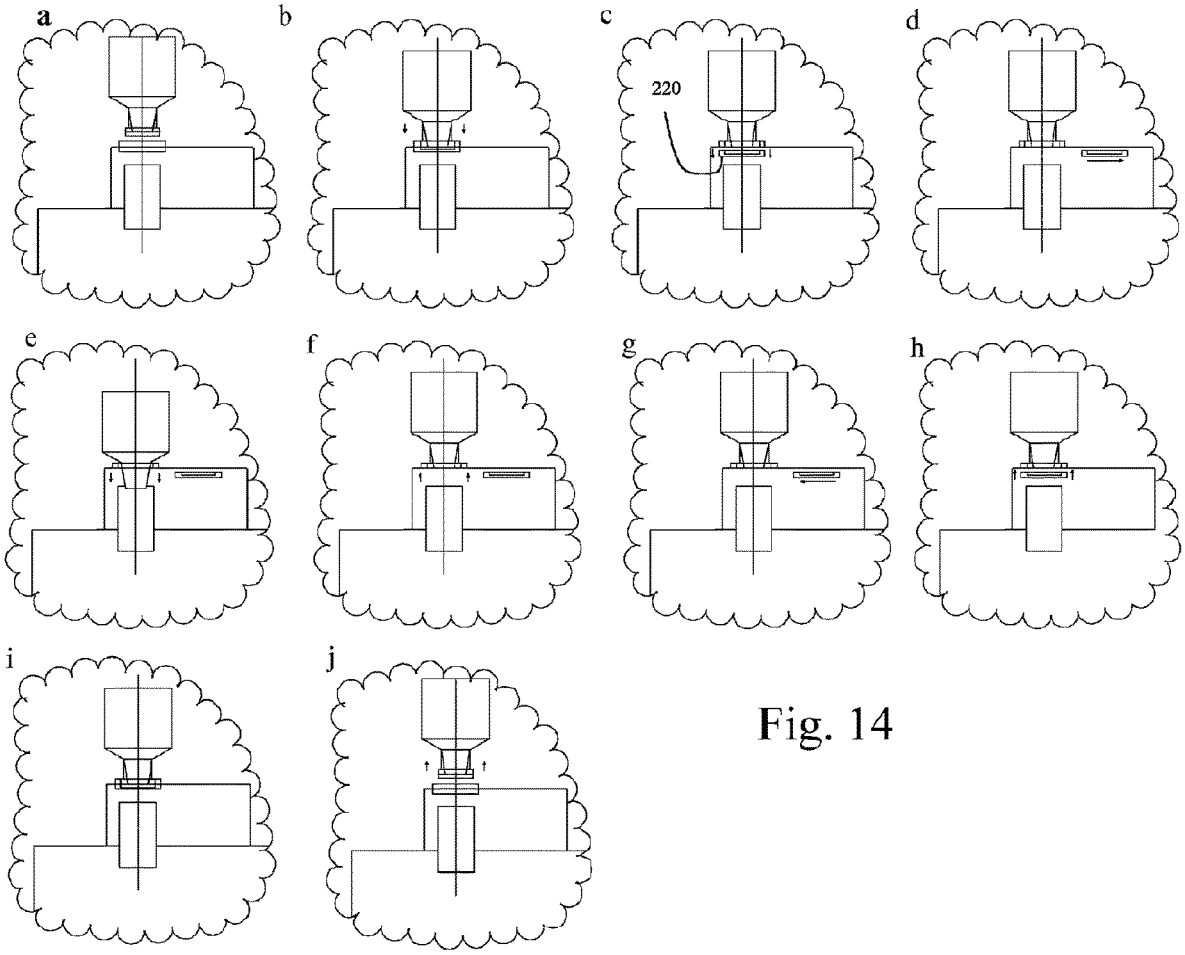
FIGS. 14 *a* to *j* show various configurations of the embodiment of FIG. 13.

FIGS. 14 *a* to *j* show schematically the various configurations of the assembly 200 to open and close the alpha and beta ports to facilitate the movement of material into the chamber and the movement of the two doors of the alpha and beta port when connected 220. The arrows show the direction of movement of the various components of the system during use.

The invention claimed is:

1. A device for sealingly connecting two enclosed volumes, comprising an alpha flange and a beta flange sealingly engageable with one another, said alpha flange fixable to a first enclosure, defining an alpha port to a first enclosed volume, and connectable to an alpha door, said alpha port having a closed configuration wherein the alpha flange is sealingly engaged with the alpha door when connected thereto and an open configuration wherein the alpha flange is separated from the alpha door and thereby permits material to pass through the alpha port;

said beta flange fixable to an second enclosure, defining a beta port to a second enclosed volume, and connectable to a beta door, said beta port having a closed configuration wherein the beta flange is sealingly engaged with the beta door and an open configuration wherein the beta flange is separated from the beta door and thereby permits material to pass through the beta port; and a protective member capable of moving from a stowed configuration to an extended configuration overlaying a junction between the alpha and beta flanges when sealingly engaged with one another.

2. The device as claimed in claim 1, wherein the alpha and beta doors are retracted behind a shield when the alpha and beta doors are open.

3. The device as claimed in claim 1, wherein the alpha flange comprises a protective member actuator operatively connected to the protective member, said protective member actuator capable of moving the protective member to and from the extended and stowed configurations and being operated externally to the first and second enclosed volumes.

4. An alpha/beta port system, comprising the device according to claim 1, wherein the alpha flange, the alpha port, and the alpha door form an alpha port assembly, and the beta flange, the beta port, and the beta door form a beta port assembly, and wherein when the beta door is in the open configuration it is connected to the alpha door and is movable therewith.

5. The system as claimed in claim 4, wherein the alpha and beta port assemblies are engageable with one another and secured via mating members.

6. The system as claimed in claim 4, wherein the alpha and beta port assemblies comprise a plurality of mating members.

7. The system as claimed in claim 6, wherein the mating members are disposed on the alpha and beta doors.

8. The system as claimed in claim 4, wherein the beta port comprises the protective member.

9. The system as claimed in claim 4, wherein the protective member further comprises a gaiter.

10. The system as claimed in claim 4, wherein the opening and closing of the alpha door is controlled by a door actuator.

11. The system as claimed in claim 10, wherein the door actuator is operatively connected to a curved arm to which the alpha door is mounted at one end and to which the other end is mounted on a shoulder, wherein the shoulder is capable of translational movement to move the alpha door rearwardly from the alpha port and capable of rotational movement to pivot the alpha door away from the alpha port such the alpha door does not obstruct the alpha port.

12. The system as claimed in claim 4, wherein the alpha port assembly further comprises a chute extending away from the alpha and beta ports.

13. The system as claimed in claim 4, wherein the beta port assembly comprises a protective member actuator operatively connected to the protective member.

14. The system as claimed in claim 4, further comprising a sterilizing module capable of overlying the door of the alpha port or the beta port and forming a chamber therebetween into which a sterilizing fluid may pass.

15. The system as claimed in claim 4, wherein the system comprises an intermediate configuration wherein the alpha and beta ports are sealingly connected with the alpha and beta doors thereby forming a chamber therebetween, said chamber having a sterilizer capable of decontaminating the outer surfaces of the alpha and beta doors and/or the junction between the alpha and beta assemblies.

16. The system as claimed in claim 15, wherein the sterilizer comprises any one or more of UV, ozone, steam, vaporous hydrogen peroxide, chlorine dioxide, and formaldehyde.

17. A method for transferring a material between a first enclosed volume and a second enclosed volume using the device as claimed in claim 1, which comprises 1) sealingly engaging the alpha and beta flanges while the alpha and beta ports are in the closed configurations;

2) placing the alpha and beta ports in the open configurations by moving the alpha and beta doors away from the alpha and beta flanges to permit passage through the alpha and beta ports;

3) from a position external to the first and second enclosed volumes, moving the protective member from the stowed configuration to the extended configuration to overlay the junction between the first and second flanges, and then passing the material through the alpha and beta ports.

18. The method as claimed in claim 17, wherein the protective member is moved by a protective member actuator.

19. The method as claimed in claim 17, further comprising sealingly engaging the beta door with the beta flange.

20. The method as claimed in claim 19, further comprising locking the beta door to the beta flange such that the beta door cannot be disengaged from the beta flange.

* * * * *